US007924983B2

(12) United States Patent
Moore

(10) Patent No.: US 7,924,983 B2
(45) Date of Patent: Apr. 12, 2011

(54) THERMIONIC EMITTER DESIGNED TO CONTROL ELECTRON BEAM CURRENT PROFILE IN TWO DIMENSIONS

(75) Inventor: Paul D. Moore, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 127 days.

(21) Appl. No.: 12/165,279

(22) Filed: Jun. 30, 2008

(65) Prior Publication Data

US 2009/0323898 A1 Dec. 31, 2009

(51) Int. Cl.
*H01J 35/06* (2006.01)

(52) U.S. Cl. ..... 378/136; 378/122

(58) Field of Classification Search ..... 378/122, 378/136

See application file for complete search history.

(56) References Cited

U.S. PATENT DOCUMENTS

| | | | | |
|---|---|---|---|---|
| 3,194,625 | A | 7/1965 | Danko | |
| 3,558,967 | A | 1/1971 | Miriam | |
| 3,737,706 | A | 6/1973 | Lindburg et al. | |
| 3,942,393 | A | 3/1976 | Forster et al. | |
| 3,946,261 | A * | 3/1976 | Holland et al. | 378/134 |
| 4,065,689 | A | 12/1977 | Pleil | |
| 4,065,690 | A | 12/1977 | Maeyama | |
| 4,573,186 | A | 2/1986 | Reinhold | |
| 4,574,388 | A | 3/1986 | Port et al. | |
| 4,670,895 | A | 6/1987 | Penato et al. | |
| 4,730,353 | A * | 3/1988 | Ono et al. | 378/138 |
| 4,736,400 | A | 4/1988 | Koller et al. | |
| 4,739,214 | A | 4/1988 | Barr | |
| 4,788,705 | A | 11/1988 | Anderson | |
| 4,792,687 | A | 12/1988 | Mobley | |
| 4,823,371 | A | 4/1989 | Grady | |
| 4,825,123 | A | 4/1989 | Franzel et al. | |
| 4,995,065 | A | 2/1991 | Janouin et al. | |
| 5,056,126 | A | 10/1991 | Klostermann et al. | |
| 5,077,777 | A | 12/1991 | Daly | |
| 5,264,801 | A | 11/1993 | DeCou, Jr. et al. | |

(Continued)

FOREIGN PATENT DOCUMENTS

| | | |
|---|---|---|
| DE | 43 04 142 | 8/1993 |
| JP | 01-141646 | 6/1989 |
| JP | 06-231678 | 8/1994 |
| JP | 11 283543 | 10/1999 |
| JP | 2002-365239 | 12/2002 |

OTHER PUBLICATIONS

Search Report issued Jun. 2010 in connection with Dutch Patent Application No. 1036209.

(Continued)

*Primary Examiner* — Jurie Yun
(74) *Attorney, Agent, or Firm* — Maschoff Gilmore & Israelsen

(57) ABSTRACT

An electron emitter assembly for use in an x-ray emitting device or other electron emitter-containing device is disclosed. In one embodiment, an x-ray tube is disclosed, including a vacuum enclosure that houses both an anode having a target surface, and a cathode positioned with respect to the anode. The cathode includes an electron emitter assembly for emitting a beam of electrons during tube operation. The electron emitter assembly comprises a refractory metal foil with a plurality of shaped rung structures for emitting an electron beam that maximizes flux while simultaneously focusing the electron beam in two dimensions. Focusing occurs primarily through an electrical field shaped by the electron emitter assembly and through balancing current density, electrical resistance, and heat loss through thermal conduction to control the regions that emit electrons. Furthermore, the refractory metal foil can be configured with a modified work function for preferential electron emission.

25 Claims, 11 Drawing Sheets

U.S. PATENT DOCUMENTS

| | | | | |
|---|---|---|---|---|
| 5,515,413 | A | 5/1996 | Knudsen et al. | |
| 5,623,530 | A | 4/1997 | Lu et al. | |
| 5,633,907 | A | 5/1997 | Gravelle et al. | |
| 6,066,019 | A | 5/2000 | Bewlay | |
| 6,252,937 | B1 * | 6/2001 | Snyder | 378/141 |
| 6,259,193 | B1 | 7/2001 | Lipkin et al. | |
| 6,289,078 | B1 | 9/2001 | Snoeren et al. | |
| 6,333,969 | B1 | 12/2001 | Kujirai | |
| 7,062,017 | B1 | 6/2006 | Runnoe | |
| 7,539,286 | B1 | 5/2009 | Bandy et al. | |
| 2003/0010911 | A1 | 1/2003 | Palmer et al. | |

OTHER PUBLICATIONS

International Search Report and the Written Opinion of the International Searching Authority issued Feb. 2010 in connection with International Application No. PCT/US2009/048032.

U.S. Appl. No. 09/639,684, mail date Oct. 17, 2001, Non-final Rejection.

U.S. Appl. No. 09/639,684, mail date Jul. 8, 2002, Final Rejection.

U.S. Appl. No. 09/639,684, mail date Jan. 9, 2003, Non-final Rejection.

U.S. Appl. No. 09/639,684, mail date Aug. 13, 2003, Non-final Rejection.

U.S. Appl. No. 09/639,684, mail date Feb. 9, 2004, Final Rejection.

U.S. Appl. No. 09/639,684, mail date Aug. 10, 2004, Non-final Rejection.

U.S. Appl. No. 09/639,684, mail date Jan. 25, 2005, Final Rejection.

U.S. Appl. No. 09/639,684, mail date Jan. 26, 2006, Notice of Allowance.

U.S. Appl. No. 11/942,656, mail date Jan. 13, 2009, Notice of Allowance.

* cited by examiner

THERMIONIC EMITTER DESIGNED TO CONTROL ELECTRON BEAM CURRENT PROFILE IN TWO DIMENSIONS

CROSS-REFERENCE TO RELATED APPLICATIONS

U.S. patent application Ser. No. 11/942,656 entitled "FILAMENT ASSEMBLY HAVING REDUCED ELECTRON BEAM TIME CONSTANT" and U.S. Pat. No. 7,062,017 entitled "INTEGRAL CATHODE" are each incorporated herein by reference in their entirety.

BACKGROUND OF THE INVENTION

1. The Field of the Invention

The present invention relates generally to electron emitters. More particularly, the present invention relates to thermionic emission of electrons for x-ray generation.

2. The Relevant Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure that contains a cathode assembly and an anode assembly. The vacuum enclosure may be composed of metal such as copper, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the electron source by the process of thermionic emission. An electric potential on the order of about 4 kV to over about 200 kV is applied between the cathode and the anode in order to accelerate electrons boiled off the electron source toward the target surface of the anode assembly. X-rays are generated when the highly accelerated electrons strike the target.

Most of the electrons that strike the anode dissipate their energy in the form of heat. Some electrons, however, interact with the atoms that make up the target and generate x-rays. The wavelength of the x-rays produced depends in large part on the type of material used to form the anode surface. X-rays are generally produced on the anode surface through two separate phenomena. In the first, the electrons that strike the cathode carry sufficient energy to "excite" or eject electrons from the inner orbitals of the atoms that make up the target. The material emits x-rays having a characteristic wavelength when the vacancies created by the "excited" or ejected electrons are filled by electrons from outer orbitals. In the second process, some of the electrons from the cathode interact with the atoms of the target element such that the electrons are decelerated around them. These decelerating interactions are converted into x-rays by conservation of momentum through a process called bremstrahlung. Some of the x-rays that are produced by these processes ultimately exit the x-ray tube through a window of the x-ray tube, and interact with a patient, a material sample, or another object.

It is generally desirable to maximize x-ray flux (i.e., the number of x-ray photons emitted per unit time) and minimize the extent of the x-ray source on the anode surface in order to produce a tightly controlled x-ray beam source. These goals are not always compatible.

It is generally acknowledged that diagnostic image quality is at least partially a function of the number of electrons that impinge upon the target surface of the target anode. In general, more electrons results in higher x-ray flux, which in turn results in x-ray images with higher contrast (i.e., higher quality). The performance of a particular emitter can thus be evaluated in terms of the efficiency of that emitter, where the efficiency of the emitter is defined as the number of electrons impinging upon the target surface of the target anode, i.e., the perveance of the emitter, as a percentage of the total number of electrons discharged by the emitter. In general then, image contrast or quality improves as the efficiency of the emitter increases.

While the quality of the images generated by an x-ray device is to a large extent a function of emitter efficiency, it is also well understood that the quality of diagnostic images additionally depends on the pattern, or focal spot, created by the emitted beam of electrons on the target surface of the target anode. In general, a smaller focal spot produces better quality x-ray images. This phenomenon can readily be analogized to the shadows produced by a visual light source. For example, the shadows cast by a sharp light source (e.g., a point source such as a laser) are themselves sharp, while the shadows cast by a poorly defined light source (e.g., fluorescent office lights) are themselves poorly defined and diffuse. The same is true of the shadows cast by the x-rays that are transmitted and absorbed as x-rays pass through a subject.

Another important consideration in the design of x-ray devices is the physical limits of the anode. As mentioned above, x-rays are generated when electrons from the electron beam strike the anode surface. Nevertheless, the fact that most of the electrons that impinge on the anode surface dissipate their energy in the form of heat can sometimes lead to anode overheating and failure if the electron beam flux is very high and/or the electron beam is relatively intense and very tightly focused on the anode surface. This is especially true in the 60-150 kilovolt operating range typical of diagnostic medical x-ray devices.

Based on the foregoing discussion, it should be generally understood that it is desirable to have an electron emitter that maximizes electron beam flux for optimal x-ray image contrast, while simultaneously providing for the smallest focal area allowable within the physical limits of the anode.

SUMMARY OF SELECTED EMBODIMENTS THE INVENTION

Embodiments of the present invention are directed to a thermionic emitter designed to emit a well-defined, high-intensity beam of electrons for generating x-rays. The emitter is fabricated from a refractive metal that emits or "boils off" electrons when heated by an electrical current. Electron emission is dependent on the amount of current flowing through the emitter and on the temperature of the emitter. The thermionic emitter design of the present invention generates maximum electron flux limited only by the physical limits of the anode, while simultaneously producing an electron beam that is highly focused in two-dimensions. The emitter is configured to control the emission profile of electrons in two dimensions by balancing current flow, resistance, and thermal conduction by the emitter element. High electron beam flux increases x-ray intensity, which improves x-ray image contrast and reduces the amount of time required to capture an x-ray image. A highly focused beam of electrons that is focused on a small area on the target anode produces a tightly collimated beam of x-ray that improves x-ray image resolution.

In one embodiment, an electron emitter assembly is disclosed. The electron emitter assembly includes a refractory metal foil configured to emit electrons when the refractory metal foil is electrically energized, and means for focusing the electrons in two dimensions so as to define an electron beam. The electron beam is typically focused in a plane defined by any two of the Cartesian coordinates (e.g., X-Y or X-Z). In a preferred embodiment, the electron beam is focused in the X-Z plane.

In one embodiment, the means for focusing the electrons in two dimensions balances a plurality of physical properties of the refractory metal foil, including current density, resistance, and thermal conduction. In a related embodiment, the means for focusing the beam of electrons in two dimensions shapes the electrical field.

In one embodiment, a plurality of regions are cut out of the refractory metal foil of the electron emitter assembly. The refractory metal foil that is left between the cut-outs defines a plurality of rungs. The cross-sectional area of the plurality of rungs is selected to balance current density, electrical resistance, and heat loss through thermal conduction. The rungs are configured to produce a controlled thermal profile across the extent of the rung. This thermal profile determines the electron emission from the points on the surface of the rung. The cross-sectional area of each rung is configured such that the plurality of rungs collectively emit a controlled beam of electrons when the refractory metal foil is energized.

The electrons emitted are essentially following parallel paths from the surface of the emitter and are then focused by the remaining structure of the cathode assembly to the desired profile of the electron beam and subsequently the desired profile of the x-ray focal spot where the beam impacts the anode. The desired profile is a line shape function of the intensity of the x-ray beam that is in the shape of a cosine function. Other line shapes of focal spot distributions are also producible by the emitter since the temperature at any point on the emitter is controlled by the cross sectional shape of the rung balanced with the thermal conduction to other parts of the rung and the thermal radiation from the surface of the rung. A nearly rectangular beam profile is also possible.

Electron emission by the refractory metal foil is dependent on temperature such that electron emission is reduced as the temperature of the refractory metal foil is reduced. In one embodiment, each rung has an associated temperature gradient that defines a temperature-dependent electron emission profile where electron flux (i.e., the number of electrons that are emitted per unit area) drops by about a factor of 2 for about every 80° C. in temperature drop. In one embodiment, the each rung further includes a middle portion and two end portions, wherein the associated temperature gradient ranges from about 2500° C. at the middle portion to about 700° C. at the two end portions.

In one embodiment, at least a portion of the refractory metal foil defines a heat transfer path to a heat sink. One will of course appreciate that the heat sink plays a role in generating the associated temperature gradient.

In one embodiment, the rungs are electrically connected to one another in series. In another embodiment, the rungs are electrically connected to one another in parallel.

In one embodiment, the refractory metal foil is fabricated from tungsten, tantalum, a tantalum-tungsten alloy (e.g., $Ta_{90}W_{10}$ or $Ta_{97.5}W_{2.5}$), or tantalum carbide. In another embodiment, the refractory metal foil is fabricated from tungsten doped with thorium. Addition of thorium alters the characteristic work function of the metal, which in turn alters the energy required for the emission of electrons. In another embodiment, the thorium doped tungsten further comprises a carbon dopant. The carbon dopant can be added to the emitter through a process called carburization. Addition of the carbon dopant significantly increases the useful lifespan of an electron emitter assembly fabricated from thoriated tungsten.

In yet another embodiment, an x-ray tube assembly is disclosed. The disclosed x-ray tube assembly includes a vacuum enclosure, an anode positioned within the vacuum enclosure and including a target surface, and a cathode spaced apart from the target surface. The cathode includes an electron emitter assembly that includes a refractory metal foil configured for emitting a beam of electrons that is thermally controlled in two dimensions. The refractory metal foil includes first and second end portions, a middle portion that is offset and parallel to the end portions, and a plurality of cut-outs that define a plurality of horizontal rungs, with the plurality of horizontal rungs being interleaved with the plurality of cut-outs.

In disclosed embodiments, each rung has a middle portion and two end portions, with the middle portion having a relatively wider cross-section than the end portions. The shape of the rungs affects the electron emission profile of the rungs by balancing current density, resistance, and heat loss through thermal conduction and thermal radiation. In turn, the electron emission profile affects focusing of the electron beam on the target anode.

In yet another embodiment an x-ray imaging device is disclosed. The disclosed x-ray imaging device includes an x-ray detector, and an x-ray source. The x-ray source includes a vacuum enclosure, an anode positioned within the vacuum enclosure and including a target surface; and a cathode spaced apart from the target surface. In particular, the electron emitter assembly includes a refractory metal foil electron emitter configured to emit a beam of electrons that is focused in two dimensions, with the refractory metal foil comprising, first and second end portions, a depressed middle portion, and a plurality of cut-outs that define a plurality of rungs, with the plurality of rungs being interleaved with the plurality of cut-outs, wherein each rung has a middle portion and two end portions, the middle portion having a relatively wider cross-section than the end portions, and wherein the cross-section of each rung is selected to balance current density, resistance, and thermal conduction and radiation such that a focused beam of electrons is collectively emitted from the rungs.

In one embodiment, the rungs are arranged substantially parallel to one another between the first and second end portions.

In one embodiment, the refractory metal foil is fabricated from tungsten, tantalum, a tantalum-tungsten alloy (e.g., $Ta_{90}W_{10}$), or tantalum carbide. In another embodiment, the refractory metal foil is fabricated from an alloy of thorium and tungsten. In yet another embodiment, the refractory metal foil further includes a carbon dopant.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Example embodiments of present invention are directed to a thermionic electron emitter designed to emit a well-defined, high-intensity beam of electrons for generating x-rays. In particular, disclosed embodiments are directed to an electron emitter that emits a self-focusing beam of electrons that is shaped in two dimensions. The electron emitter is fabricated from a refractive metal that emits or "boils off" electrons when heated by an electrical current. Electron emission is dependent on the amount of current flowing through the electron emitter which determines the temperature of the electron emitter. The thermionic electron emitter design of the present invention generates maximum electron flux limited only by the physical limits of the anode, while simultaneously producing an electron beam that is intentionally shaped in two-dimensions. The electron emitter is configured to control the emission profile of electrons in two dimensions by balancing current density, resistance, and thermal conduction and radiation by the electron emitter element. High electron beam flux increases x-ray intensity, which improves x-ray image contrast and reduces the amount of time required to capture an x-ray image. A highly focused beam of electrons that is focused on a small area on the target anode produces a tightly controlled focal spot that improves x-ray image resolution.

I. X-Ray Devices

Figure 1:
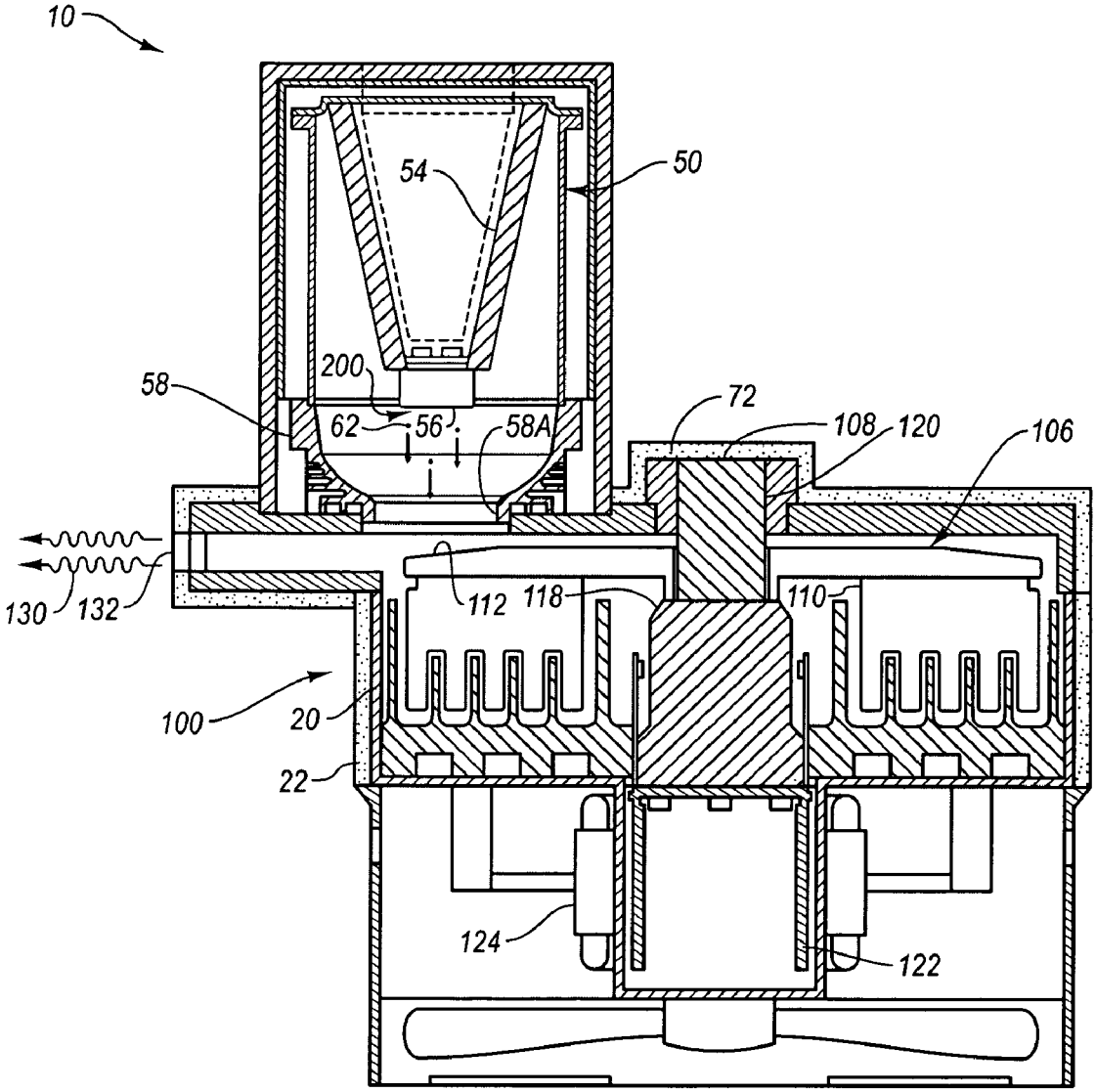
FIG. 1 illustrates a cross sectional side view of an x-ray tube that serves as one possible environment for inclusion of the present invention, according to one embodiment.

Reference is first made to FIG. 1, which depicts one possible environment wherein embodiments of the present invention can be practiced. Particularly, FIG. 1 shows an x-ray tube, designated generally at 10, which serves as one example of an x-ray generating device. The x-ray tube 10 generally includes an evacuated enclosure 20 that houses a cathode assembly 50 and an anode assembly 100. The evacuated enclosure 20 defines and provides the necessary envelope for housing the cathode and anode assemblies 50, 100 and other critical components of the tube 10 while providing the shielding and cooling necessary for proper x-ray tube operation. The evacuated enclosure 20 further includes shielding 22 that is positioned so as to prevent unintended x-ray emission from the tube 10 during operation. Note that, in other embodiments, the x-ray shielding is not included with the evacuated enclosure, but rather might be joined to a separate outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. While other configurations could be used, in the illustrated example the cathode assembly 50 includes a support structure 54 that supports a cathode head 56. In the example of FIG. 1, a cathode aperture shield 58 defines an aperture 58A that is positioned between an electron emitter assembly, generally designated at 200 and described in further detail below, and the anode 106 to allow electrons 62 emitted from the electron emitter assembly to pass. The aperture shield 58 in one embodiment can be cooled by a cooling fluid as part of a tube cooling system (not shown) in order to remove heat that is created in the aperture shield as a result of errant electrons impacting the aperture shield surface. FIG. 1 is representative of one example of an environment in which the disclosed filament assembly might be utilized. However, it will be appreciated that there are many other x-ray tube configurations and environments for which embodiments of the filament assembly would find use and application.

As mentioned, the cathode head 56 includes the electron emitter assembly 200 as an electron source for the production of the electrons 62 during tube operation. As such, the electron emitter assembly 200 is appropriately connected to an electrical power source (not shown) to enable the production by the assembly of the high-energy electrons, generally designated at 62.

The illustrated anode assembly 100 includes an anode 106, and an anode support assembly 108. The anode 106 comprises a substrate 110 preferably composed of graphite, and a target surface 112 disposed thereon. The target surface 112, in one example embodiment, comprises tungsten or tungsten rhenium, although it will be appreciated that depending on the application, other "high" Z materials/alloys might be used. A predetermined portion of the target surface 112 is positioned such that the stream of electrons 62 emitted by the electron emitter 200 and passed through the shield aperture 58A impinge on the target surface so as to produce the x-rays 130 for emission from the evacuated enclosure 20 via an x-ray transmissive window 132.

The production of x-rays described herein can be relatively inefficient. The kinetic energy resulting from the impingement of electrons on the target surface also yields large quantities of heat, which can damage the x-ray tube if not dealt with properly. Excess heat can be removed by way of a number of approaches and techniques. For example, in the disclosed embodiment a coolant is circulated through designated areas of the anode assembly 100 and/or other regions of the tube. Again, the structure and configuration of the anode assembly can vary from what is described herein while still residing within the claims of the present invention.

In the illustrated example, the anode 106 is supported by the anode support assembly 108, which generally comprises a bearing assembly 118, a support shaft 120, and a rotor sleeve 122. The support shaft 120 is fixedly attached to a portion of the evacuated enclosure 20 such that the anode 106 is rotatably disposed about the support shaft via the bearing assembly 118, thereby enabling the anode to rotate with respect to the support shaft. A stator 124 is circumferentially disposed about the rotor sleeve 122 disposed therein. As is well known, the stator utilizes rotational electromagnetic fields to cause the rotor sleeve 122 to rotate. The rotor sleeve 122 is attached to the anode 106, thereby providing the needed rotation of the anode during tube operation. Again, it should be appreciated that embodiments of the present invention can be practiced with anode assemblies having configurations that differ from that described herein. Moreover, in still other tube implementations and applications, the anode may be stationary.

II. The Electron Emitter Assembly

Attention is now directed to FIGS. 2A-2D, wherein further details concerning embodiments of the electron emitter assembly 200 are given. As shown, in this example the electron emitter assembly 200 includes a refractory metal foil configured to emit electrons when the refractory metal foil is electrically energized. The electron emitter assembly 200 includes a plurality of end segments 202, and a plurality of rung segments 204 configured for the emission of electrons (denoted at 62 in FIG. 1) during tube operation. In the illustrated embodiment, the electron emitter assembly 200 includes a plurality end segment 202*a*-202*l* and a plurality of rung segments 204*a*-204*m*, though it is appreciated that in other embodiments, more or fewer end and rung segments can be included in the electron emitter assembly 200.

As mentioned and as depicted in FIG. 7, the illustrated electron emitter assembly 200 is typically included in a cavity 56*a* formed in a surface 56*b* of the cathode head 56, wherein the surface 56*b* generally faces toward the target surface 112 of the anode 106. The electron emitter assembly 200 is typically mounted to the cathode head 56 via screws, bolts, rivets, brazing, clamping between insulators or other suitable attachment means via a plurality of holes depicted generally at 210 or clamping against 202*a*.

The electron emitter assembly 200 further includes at least two electrical connection points, which are depicted in this embodiment at 208. The electrical connection points 208 are in electrical communication with a power source so as to enable operation of the electron emitter assembly 200. In the depicted embodiment, the rungs 204*a*-204*m* are electrically connected in series, though it is appreciated that the rungs can be connected in parallel in other embodiments. Typically, the operational current for an electron emitter assembly 200 that is connected in series is in a range of about 3 amps to about 10 amps. If the electron emitter assembly 200 is connected in parallel, the operation current is typically in a range from about 30 amps to about 50 amps.

So configured, the rungs 204*a*-204*m* operate simultaneously in emitting electrons during tube operation. During such operation, it is the central portion 218 of each rung 204 that produces electrons via thermionic emission, As will be discussed in further detail below, the overall shape and configuration of the electron emitter assembly 200 provides for sufficient heat buildup in the central portion 218 of each rung 204 for thermionic emission, while the end portions 202 are relatively cooler.

Figure 2A:
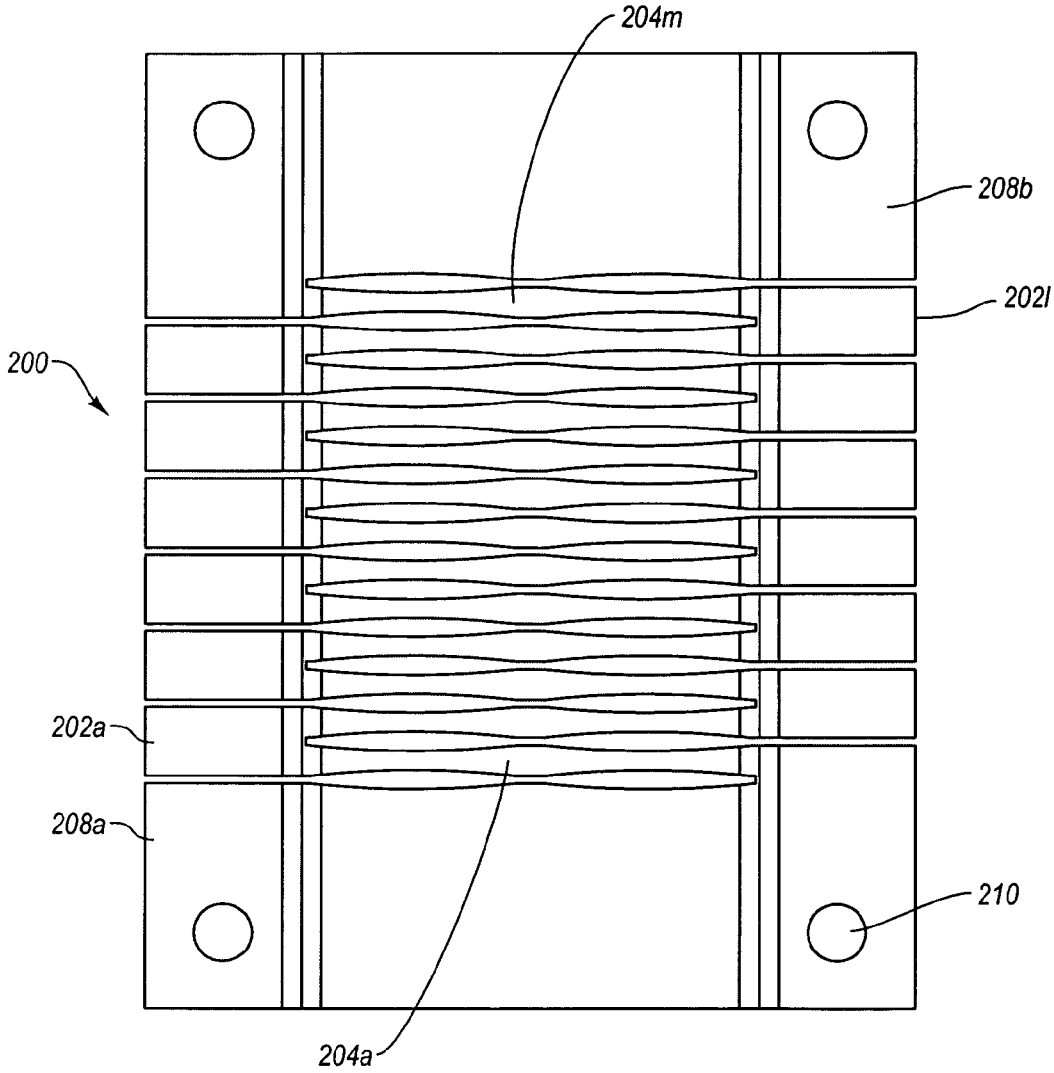
FIG. 2A illustrates a top view of an electron emitter, according to one embodiment of the present invention.
Figure 2B:
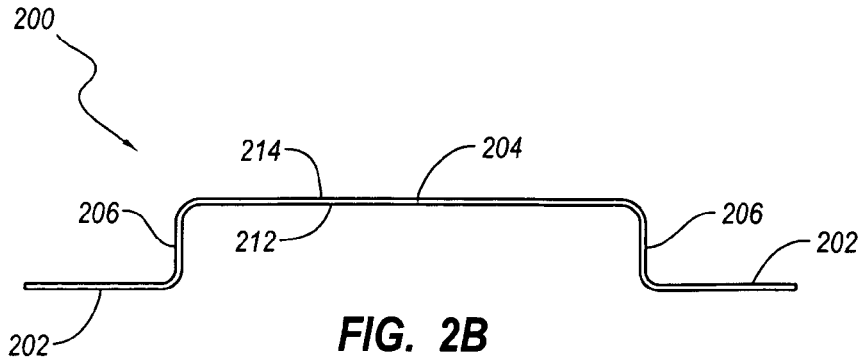
FIG. 2B illustrates an end view of the electron emitter of FIG. 2A.

FIG. 2B depicts an exemplary embodiment of the present invention in which the electron emitter assembly 200 is shaped in the form of a box-shaped depression. According to the depicted embodiment, the end portions 202 are parallel to the rung portions, and the end portions 202 are connected to the rung portions 204 via angled portions 206. The electron emitter assembly 200 includes a first surface 212 and a second surface 214 that are each contiguous with the end portions 202, the rung portions 204, and the angled portions 206. Either the first surface 212 or the second surface 214 can be oriented toward the target surface 112 of the anode 106. In the depicted embodiment, the first surface 212 is oriented toward the target surface 112 of the anode 106.

Figure 2C:
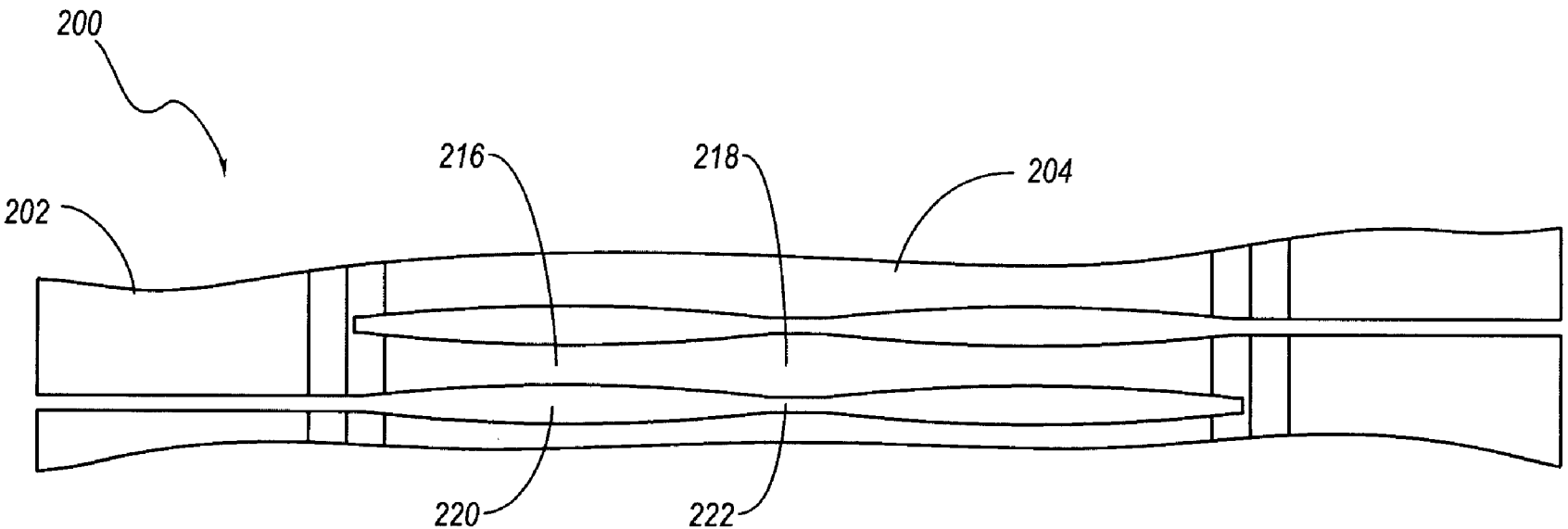
FIG. 2C illustrates a close-up view of a portion of the electron emitter of FIG. 2A.

FIG. 2C depicts a close-up view of a portion of the electron emitter assembly 200 showing details of the rung structures 204. The electron emitter assembly is typically fabricated from a refractory metal foil, with a plurality of cut-outs 220 and 222 defining a plurality of horizontal rung structures 204 that are interleaved with the cut-outs 220 and 222.

The shape of the cut-outs 220 and 222 defines the shape of the rung structures. In the depicted embodiment, the cut-outs are generally wider toward the outside of the foil 220, and the cut-outs taper toward the middle portion 222. In turn, these cut-outs 220 and 222 define a plurality of horizontal rung structures that are relatively wider in the middle 218 and that generally taper toward the end portions 216.

The cut-outs 220 and 222, and the resulting shape of the rungs 216 and 218, are configured in particular to balance current density, resistance, and thermal conduction and radiation such that a heating electrical current excites emission of electrons from a selected portion of each rung. That is, when the electron emitter assembly 200 is heated by an electrical current, electron emission will be excited from those portions of the electron emitter assembly 200 that are sufficiently hot. In particular, it is desirable for an electrical current to excite electron emission from the rungs by heating the wide portion 218 at the center of each rung 204 rung to a temperature sufficient for electron emission, while the remaining portions of each rung are relatively cooler. As will be explained more fully below, this is accomplished at least in part by configuring the electron emitter assembly so as to balance current density, resistance, and heat loss through thermal conduction and radiation. For example, the rungs 204 depicted in FIG. 2C include a narrow portion 216 and a wider portion 218 that cooperatively balance current density and resistance, while heat loss through thermal conduction is typically facilitated by placing the end portions 202 in thermal communication with a cooler support structure (see, e.g., FIG. 3). Heat loss from thermal radiation is determined by the temperature, area and composition of the emitter. These are calculated and used to determine the ultimate cross sectional profile of each rung to deliver the desired thermal profile and consequent electron emission.

According to one embodiment of the present invention, a number of processes may be used to cut out the cut-outs 220 and 222 and shape the rungs 204 as depicted in FIG. 2C. For example, the electron emitter assembly 200 is typically fabricated from a refractory metal foil, such as a tungsten foil, or a foil of a refractory metal alloy, such as an alloy of thorium and tungsten. In the fabrication process, the metal foil is first cut into the desired shape (see, e.g., FIG. 2B). A number of processes can be used to make the cut-outs 220 and 222. For example, the cut-outs 220 and 222 can be made using electronic discharge machining, photoetching, laser cutting, and combinations thereof. After cutting, the foil may be bent to have a particular profile, as depicted in FIG. 2B. Right angle bends are shown in FIG. 2B, but other configurations are possible, such as gentler angles of about 75°.

Figure 2D:
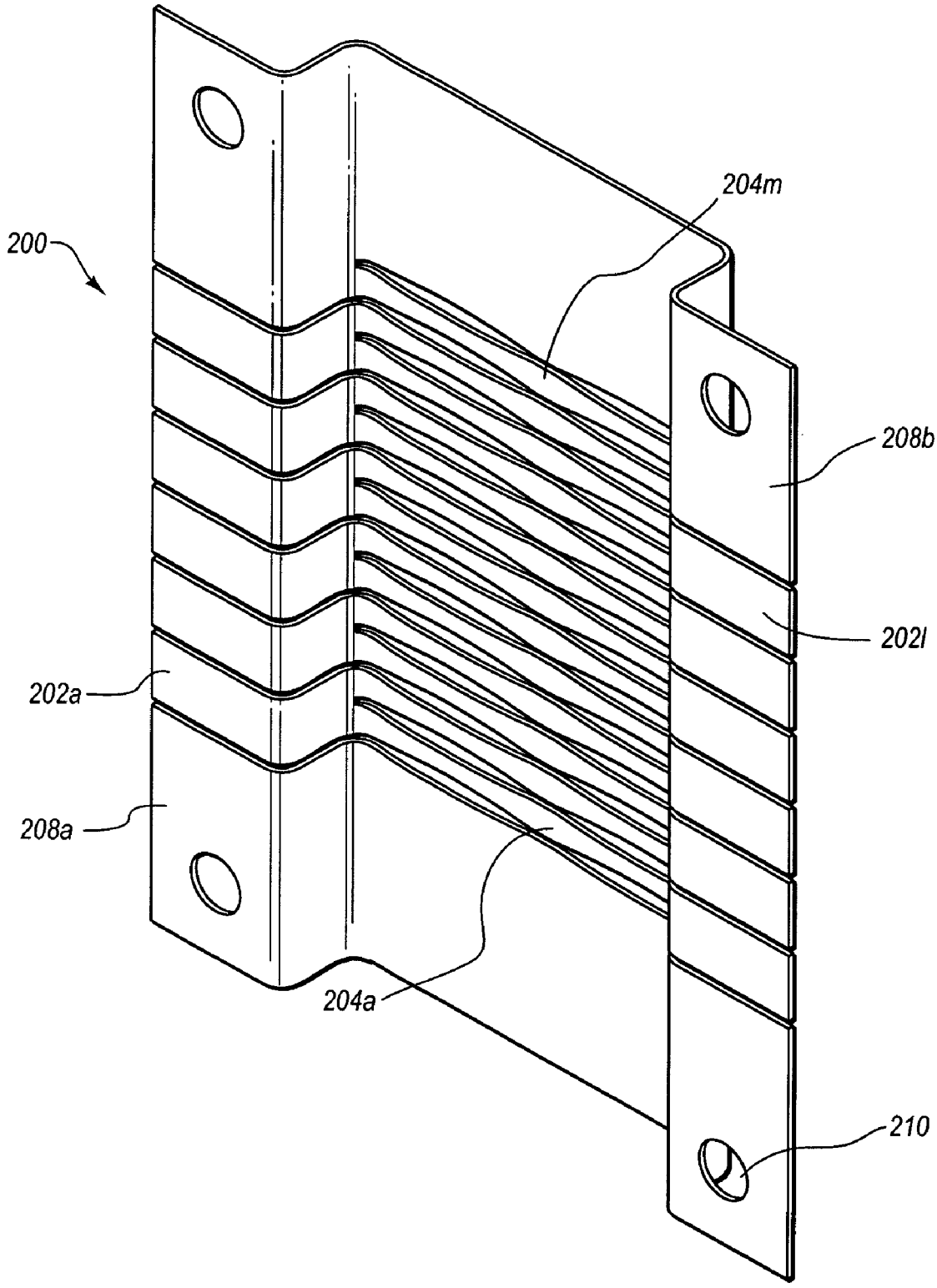
FIG. 2D illustrates a perspective view of the electron emitter of FIG. 2A.

Referring now to FIG. 2D, a perspective view is depicted showing the overall structure of an exemplary embodiment of the electron emitter assembly 200. In FIG. 2D, the overall shape of the electron emitter assembly can be clearly appreciated. In the depicted embodiment, the electron emitter assembly 200 consists of first and second end portions and a middle portion that is parallel to end portions and, as depicted, the middle portion is situated below the end portions. First and second end portions are depicted at, for example, 202*a*-202*l* and at 208*a* and 208*b*. Middle portions are depicted at, for example, 204*a*-204*m*. The end portions and middle portion form a continuous electrically conductive element. As such, the middle portion is connected to the end portions by virtue of angled segments 206.

In an alternative embodiment, an electron emitter similar to what is depicted in 2A-2D can be made from an elongate filamentous wire or rods. In either case, the wire or rods are shaped along their length and formed into a current conduction path to manipulate electrical current density, resistance, and heat loss through thermal conduction and radiation. In another alternative embodiment, the above mentioned rods can be cut in half lengthwise to present the flat side of a semicircle toward the anode. The cut rods would be shaped along their length and formed into a current conduction path to manipulate electrical current density, resistance, and heat loss through thermal conduction and radiation.

Figure 3:
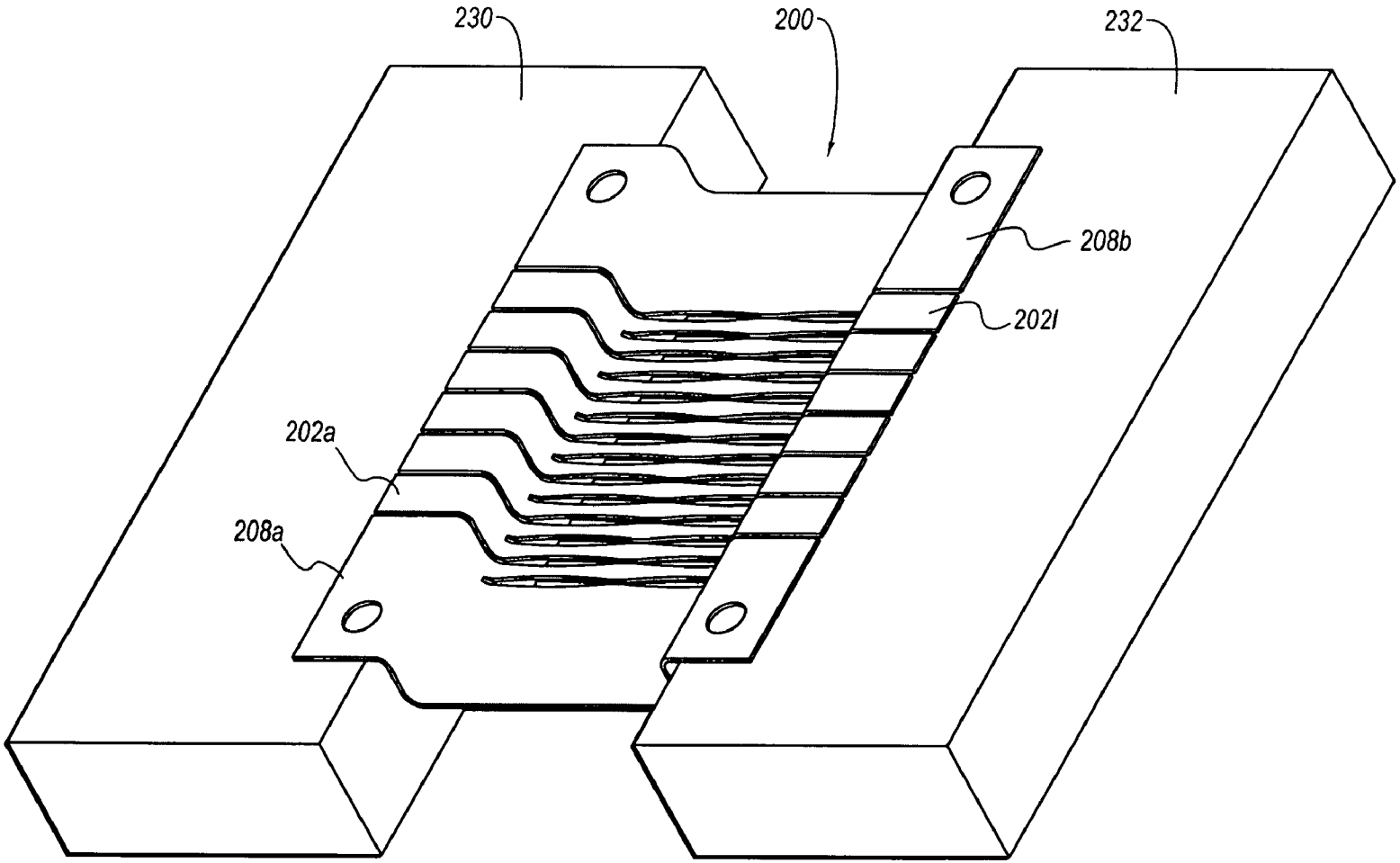
FIG. 3 illustrates an electron emitter attached to a heat sink, according to one embodiment of the present invention.

FIG. 3 illustrates an electron emitter assembly 200 attached to heat sink blocks 230 and 232, according to one embodiment of the present invention. In this embodiment, the electron emitter assembly 200 is interposed between heat sinks 230 and 232. In particular, the end portions 202*a*-202*l* of the electron emitter assembly 200 are in thermal communication with the respective adjacent heat sink 230 and 232 so as to provide a thermal path between the electron emitter assembly 200 and the heat sinks 230 and 232. This configuration provides for the conductive dissipation of heat from either end of the electron emitter assembly 200 to the heat sinks 230 and 232. Dissipation of heat from the electron emitter assembly 200 is important for limiting heat build-up in the emitter, and for controlling the regions of the emitter that emit electrons. So situated, the segments of the electron emitter assembly 200 are found in a parallel thermal configuration with respect to one another in this particular embodiment.

Heat sinking the electron emitter assembly 200 as depicted in FIG. 3 has the additional advantage of allowing electron emission to be rapidly switched on and off. That is, the beam current can be varied with minimum delay. Variance of the beam current in this manner is achieved by varying the power supply i.e., the current, which is provided to the electron emitter 200.

Figure 4:
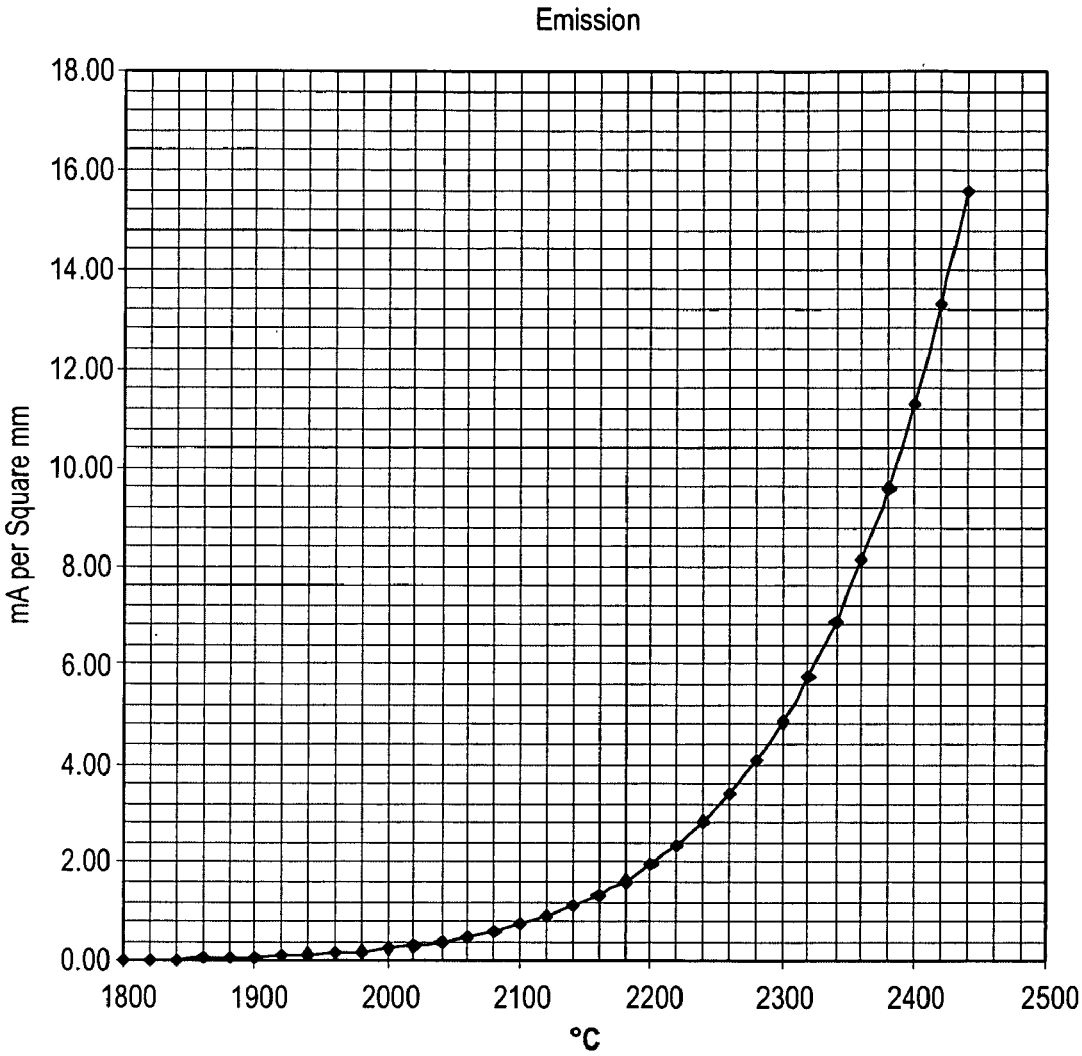
FIG. 4 is a graph illustrating the relationship between the temperature of the electron emitter and electron emission of the emitter as measured by milliamps per square millimeter.

Reference is now made to FIG. 4. FIG. 4 is a graphical depiction of electron emission from a tungsten electron emitter as a function of temperature. The relationship depicted in FIG. 4 can also be described by the following equation:

$$\text{mA emitted per square millimeter} = AT^2e^{-(\Phi/kT)} \quad \text{(Equation 1)}$$

A is a constant generally taken as equal to $20\times10^6$ $mA/mm^2K^2$ for a tungsten emitter. Φ, which is referred to as the work function, is the minimum energy (measured in electron volts) needed to remove an electron from a solid to a point immediately outside the solid surface. The work function for a given electron emitter is unique to the material or materials that the emitter is fabricated from. k is Boltzman's constant and is equal to $8.62\times10^{-5}$ eV/K. T is the temperature of the electron emitter in Kelvin. The graph depicted in FIG. 4 is specific to tungsten, and is based on a work function value of Φ=4.55 eV. Work function values are known or can be determined for other materials using known methods.

In one embodiment of the present invention, it may be desirable to alter the work function value of the electron emitter assembly to affect electron emission. For example, it may be desirable to fabricate the electron emitter assembly using thorium doped tungsten (i.e., thoriated tungsten), which has a work function value of about 2.7 eV versus 4.55 eV for pure tungsten. A lower work function value means, for example, that an electron emitter fabricated from thoriated tungsten will emit electrons more readily that a material with a higher work function value, such as tungsten. On will therefore appreciate that altering the work function value of the material used to fabricate the electron emitter assembly is one way that electron emission from the emitter can be controlled.

In one embodiment of the present invention, the thorium doped tungsten further includes a carbon dopant. That is, the thoriated tungsten is carburized. Carburization of a thoriated tungsten electron emitter assembly is typically achieved by subjecting the completed electron emitter assembly to a heat treatment in a hydrocarbon atmosphere consisting of a hydrogen carrier gas and benzene, naphthalene acetylene, or xylene. When the electron emitter assembly is heated in the presence of the hydrocarbon to a temperature on the order of 2000° C., the hydrocarbon is decomposed at the hot filament surface to form tungsten carbide that diffuses into the tungsten. Inclusion of the carbon dopant significantly increases the useful lifespan of an electron emitter assembly fabricated from thoriated tungsten by reducing the rate of thorium evaporation from the thoriated tungsten.

As can be appreciated from FIG. 4 and Equation 1, electron emission from the electron emitter is highly dependent on the temperature of the electron emitter. Appreciable increases in electron emission from tungsten occur in a relatively narrow temperature band from about 2100° C. to the saturation point at about 2500° C. where increasing the temperature further will no longer increase electron flux. One can also appreciate from FIG. 4 and Equation 1 that electron emission drops bay about a factor of 2 for about every 80° C. in temperature drop.

Figure 5A:
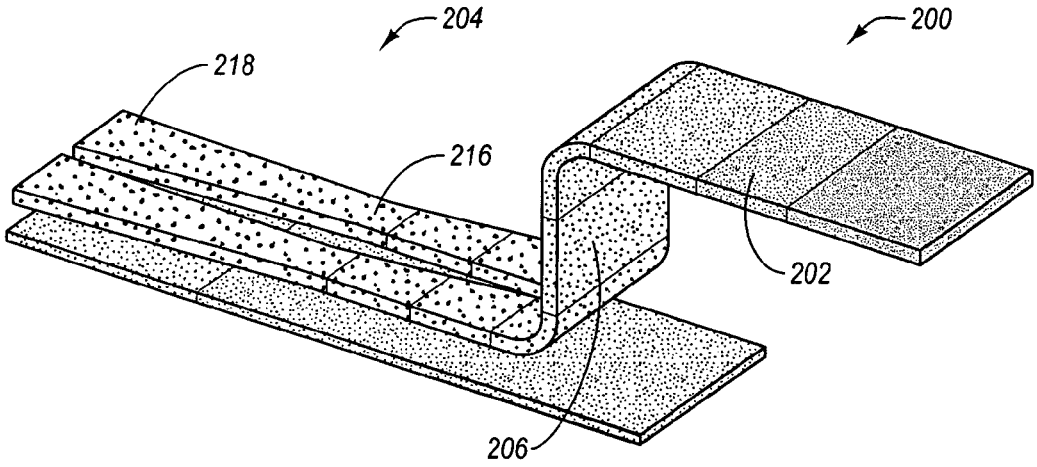
FIG. 5A illustrates an exemplary temperature gradient across a rung structure of an electron emitter.
Figure 5B:
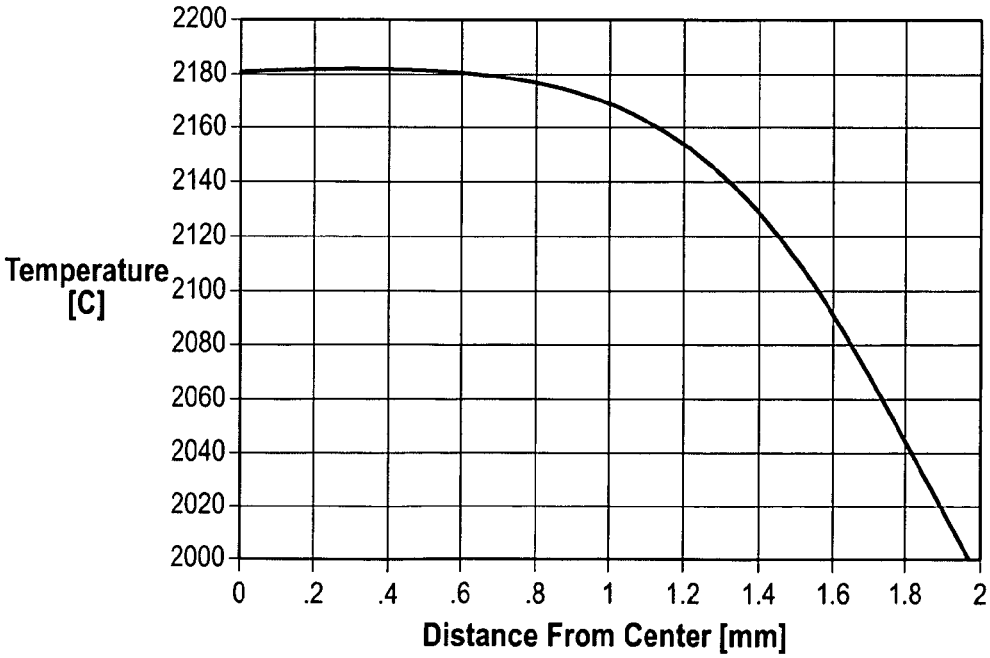
FIG. 5B is a graph illustrating the temperature gradient across the rung depicted in FIG. 5A as a function of distance from the center of the rung.
Figure 5C:
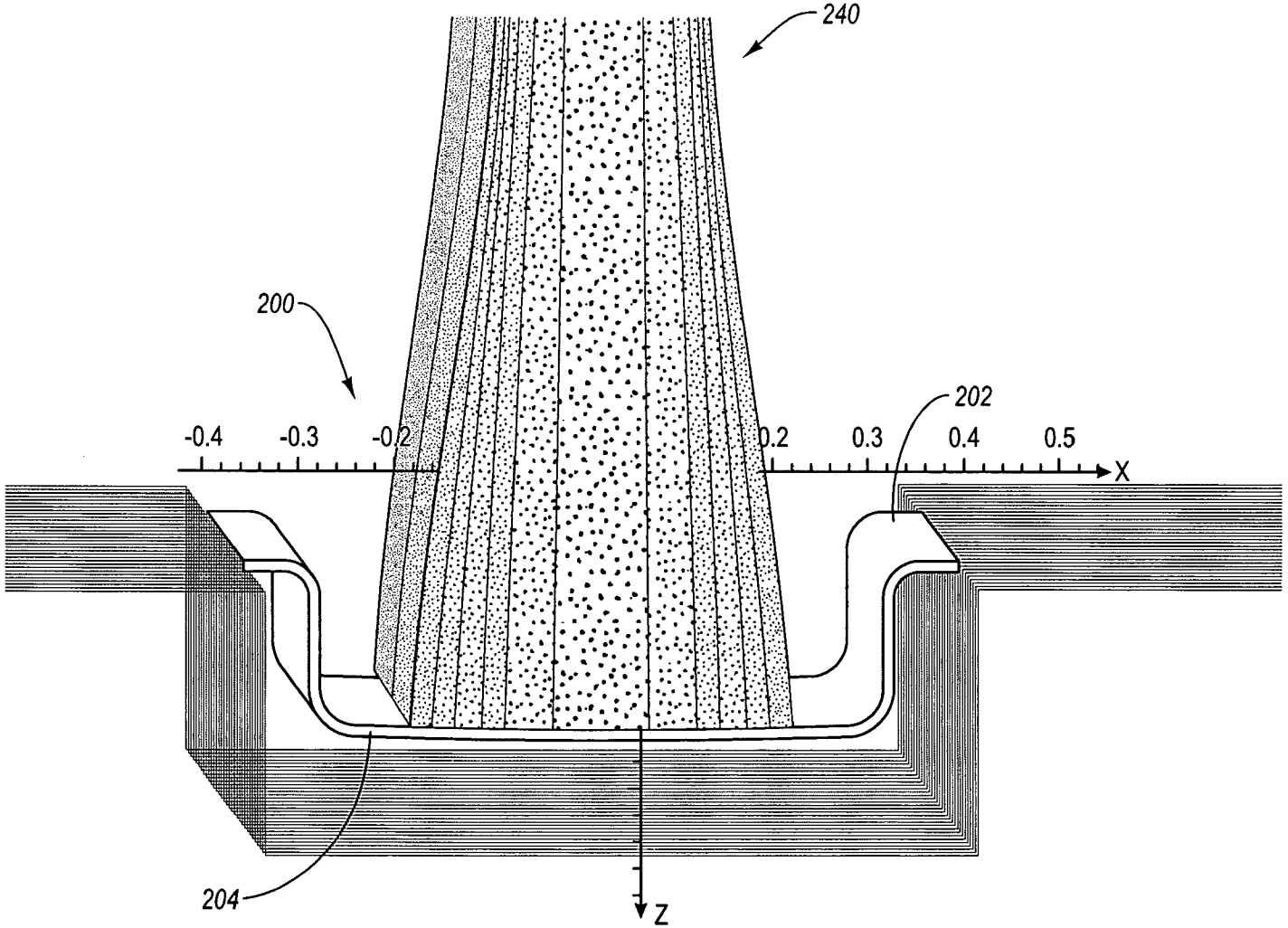
FIG. 5C illustrates the electron emission profile of an electron emitter in the X-Z plane.

Reference is now made to FIGS. 5A, 5B, and 5C. FIGS. 5A and 5C depict a temperature simulation showing an exemplary temperature gradient of a portion of an electron emitter assembly 200 and the resulting electron emission profile. FIG. 5A depicts two half rungs 204 cut down the middle of the electron emitter 200. In the simulation, the electron emitter is directly heated by about 5 Amps of current. The rungs 204 each consist of a middle portion 218 that is relatively wider than and that tapers toward a narrower portion 216, an angled portion, and an end portion 202. The simulation depicted in FIG. 5A graphically represents a typical temperature profile of an electron emitter assembly 200 in operation. FIG. 5B is a graph showing the temperature of the portion of the electron emitter assembly 200 and the pair of rungs 204 as function of the distance from the center of the rung.

As can be appreciated from FIGS. 5A and 5B, the temperature of the electron emitter is higher in the center of the rungs 218, and the temperature drops off sharply as the distance from the center increases. In the depicted simulation, the temperature of the electron emitter 200 ranges from about 2200° C. at the center of the rung 218 to about 700° C. at the end portion 202. In operation, the temperature gradient of the electron emitter 200 typically ranges from about 2500° C. at the center of the rungs 218 to about 700° C. at the ends 202. With reference to FIG. 4 and Equation 1 and FIGS. 5A and 5B, one will appreciate that because of the narrow temperature profile depicted in FIG. 5A, the electron emitter 200 will emit electrons from a relatively small area. One will therefore appreciate that one way of altering the electron emission profile of the emitter and, by extension, electron focusing is through designing the temperature profile of the electron emitter assembly 200.

As such, FIG. 5C is a close-up view of an electron emitter 200 depicting the relatively small area of the electron emitter 200 that emits electrons and the collinear paths of the electrons emitted by the electron emitter 200. Because the electrons are emitted from a relatively small, relatively flat area, relatively little is required in the way of structure to control or direct the emitted electrons. Accordingly, the dimensions and shape of the electron emitter 200 are chosen such that the emitted electrons are focused in two dimensions. In FIG. 5C, the X-Z plane is depicted on the plane of the page and the Y-axis is into the plane of the page. In the depicted embodiment, the electron emitter assembly 200 produces a beam of electrons that is focused in the X-Z plane. Accordingly, the electron emitter is shaped such that electrons are emitted in a narrow band along the Y-axis of the electron emitter and an electronic field is shaped to focus the beam of electrons in the X-Z plane. In particular, the angled sides 206 of the electron emitter 200 shape the electrical field lines that focus the beam 240 toward the target anode (112 in FIG. 1).

This significantly simplifies the focusing of the beam of electrons 240 relative to x-ray apparatuses using conventional coiled filaments. In addition, the electron emitter design described herein is much less sensitive to variations in x-ray tube geometry. For example, the angled sides 206 of the electron emitter 200 provide all the focusing required to make a very small focal spot (0.2 mm width) at a relatively large anode to cathode distance (~33 mm) at high beam current (500 mA).

Based on the description presented above, one will appreciate that the present invention includes an electron emitter assembly. An electron emitter assembly according to the present invention includes a refractory metal foil configured to emit electrons when the refractory metal foil is electrically energized, and means for focusing the electrons in two dimensions so as to define an electron beam.

In one embodiment, the present invention includes means for focusing the electrons emitted by the electron emitter in two dimensions so as to define an electron beam. The electron beam is typically focused in a plane defined by any two of the Cartesian coordinates (e.g., X-Y or X-Z). In a preferred embodiment, the electron beam is focused in the X-Z plane.

In one embodiment of the present invention, the means for focusing the electrons in two dimensions balances a plurality of physical properties of the refractory metal foil, including the properties of current density, electrical resistance, and thermal conduction and radiation. As described above, the electron emitter discharges electrons when heated by an electrical current and electron emission is highly dependent on the temperature of the electron emitter. Designing the electron emitter so as to balance current density, electrical resistance, and thermal conduction and radiation, for example, provides means for emitting a beam of electrons that is shaped in two dimensions by limiting the region of the electron emitter that emits electrons to a defined region of the electron emitter assembly 200.

In a related embodiment of the present invention, the means for focusing the electrons in two dimensions shapes the electrical field. As was described in reference to FIG. 5C, the sides of the electron emitter are configured such that electrical field lines are shaped such that the electrons emitted from a narrow region of the electron emitter are focused in two dimensions. In a preferred embodiment, the electrical field is shaped such that the electron beam is focused in the X-Z plane, however, configurations that focus the beam of electrons in other planes of the Cartesian system are within the scope of the presently described embodiments of the present invention.

Figure 6:
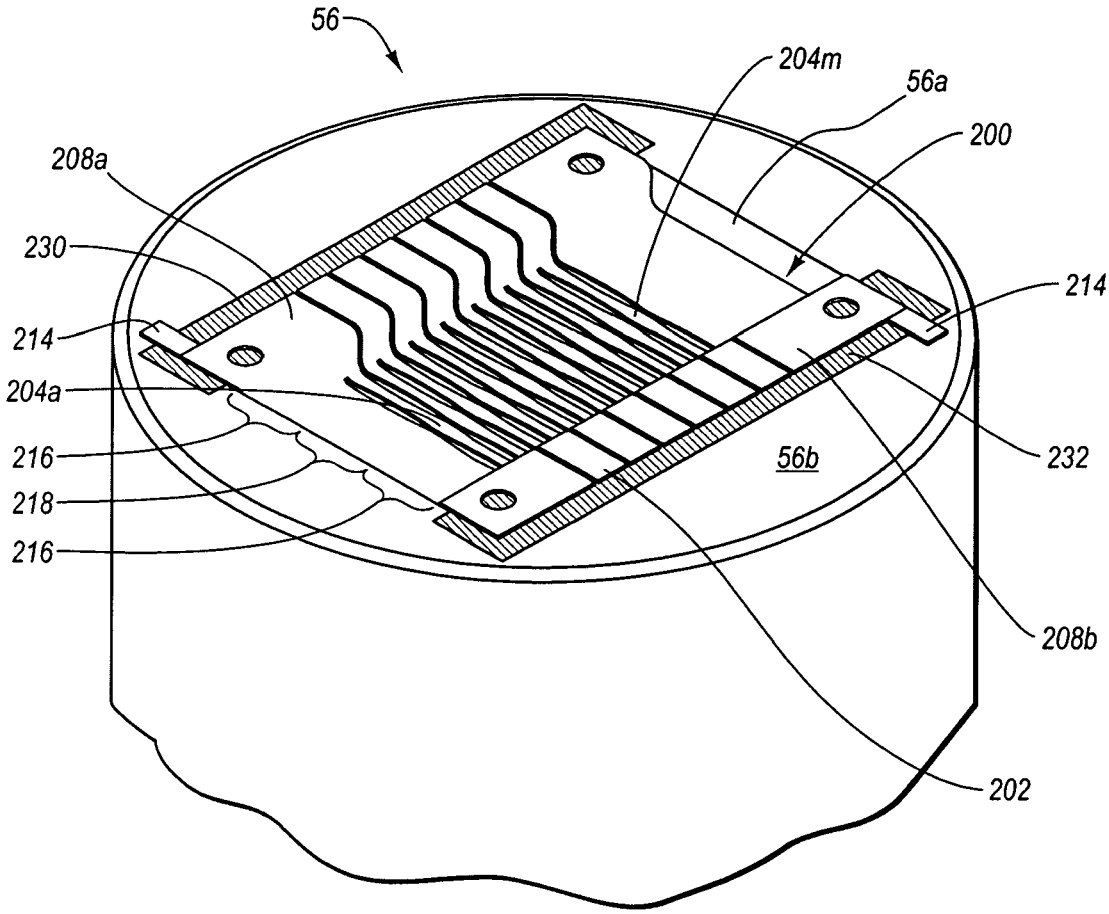
FIG. 6 illustrates a cathode head including an electron emitter assembly according to one embodiment of the present invention.

Reference is now made to FIG. 6. FIG. 6 depicts one possible example of the installation of the electron emitter assembly 200, wherein an electron emitter assembly 200 is shown disposed in a cathode head 56. The electron emitter assembly 200 includes a plurality rung segments 204*a*-204*m* as in previous embodiments. The electron emitter assembly 200 is disposed in a cavity 56*a* defined in the surface 56*a* of the cathode head 56. So positioned, the electron emitter assembly 200 is oriented to emit a stream of electrons when energized. Note that, though it is centrally located on the cathode head surface 56A, the filament assembly in other embodiments could be placed off-axis with respect to the cathode head center, if desired. This possibility exists with each of the embodiments described herein.

Each of the rung segments 204*a*-204*m* is shaped in a particular configuration, best seen in FIGS. 2A and 2C. As before, each rung segment 204*a*-204*m* includes a central portion 218 configured to emit electrons during x-ray tube operation, interposed between two adjacent end portions 216. At the perspective shown in FIG. 6, the end portions 202 of the electron emitter assembly 200 relatively flat with respect to the cathode head surface 56B, while the middle portions 216 and 218 are below the cathode head surface 56B. This configuration of the end portions 202 and the middle portions 216 and 218 desirably provides a self-focusing effect for the electrons emitted from the central portion 218.

The rung segments 204*a*-204*m* are interconnected with one another via a plurality of interconnections in the end portions 202 so as to place the segments in electrical series with respect to one another. Two outer end segments 208*a* and 208*b* are electrically connected with a respective terminal 214. Note that, though shown in electrical series here, the rung segments could alternatively be placed electrically in parallel, if desired.

The end portions 202 are mounted on one of two thermally conductive insulators 230 and 232 that are disposed at opposite ends of the cathode head cavity 56A. This provides electrical isolation of the electron emitter assembly 200 with respect to the cathode head 56 while enabling heat sinking of the filament assembly with respect to the cathode head. In an alternative embodiment, the electron emitter assembly 200 is disposed on poor thermal conductors to limit the amount of waste heat conducted to the cathode head assembly 56.

General reference is now made to FIGS. 7A-7D. As mentioned above, the electron emitter assembly of the present invention can include other configurations that reside within the claims of the present invention.

Figure 7A:
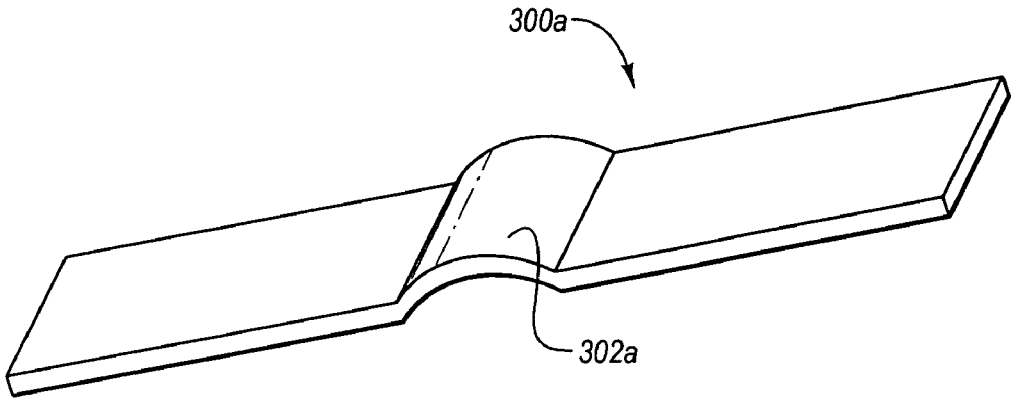
FIG. 7A illustrates an electron emitter, according to an alternative embodiment of the present invention.

FIG. 7A depicts an alternate embodiment of an electron emitter assembly 300*a* that consists of a solid refractory metal foil with a dimple region 302. The dimple region 302 is included to provide dimensional stability so that the electron emitter 300*a* presents a predictable emission surface. The dimple region 302 could either bend toward or away from the target. The electron emitter 300*a* can be brazed, clamped, or otherwise attached to heat sink and included in a cathode head for emission of electrons as in the above described embodiments.

Figure 7B:
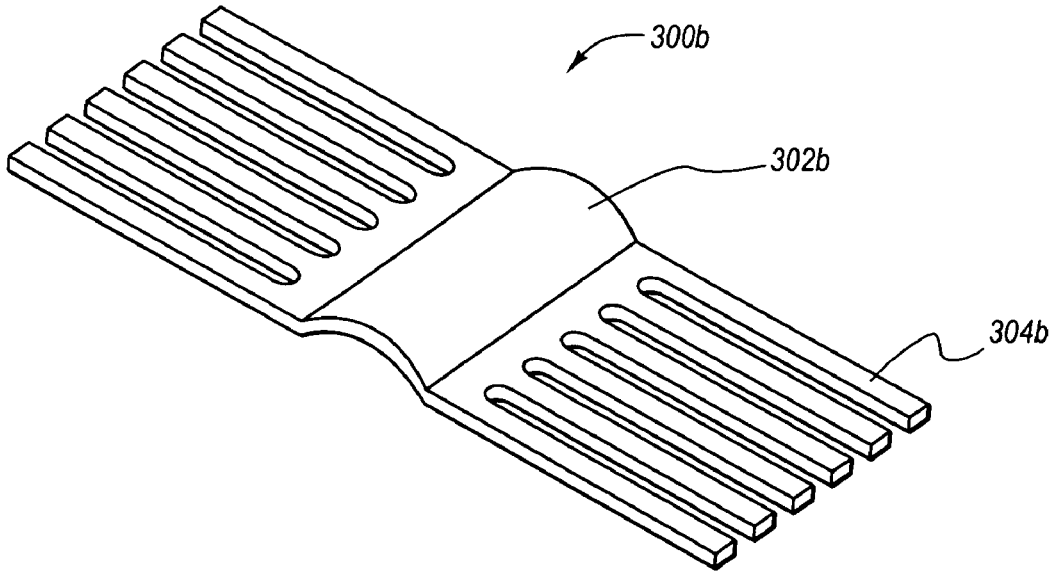
FIG. 7B illustrates another electron emitter, according to an alternative embodiment of the present invention.

FIG. 7B depicts another alternate embodiment of an electron emitter assembly 300*b* that is similar in many respects to FIG. 7A. The electron emitter 300*b* consists of a solid refractory metal foil with a dimple region 302*b*. In addition, electron emitter 300*b* includes plurality of slots 304*a* for thermal heat sinking.

Figure 7C:
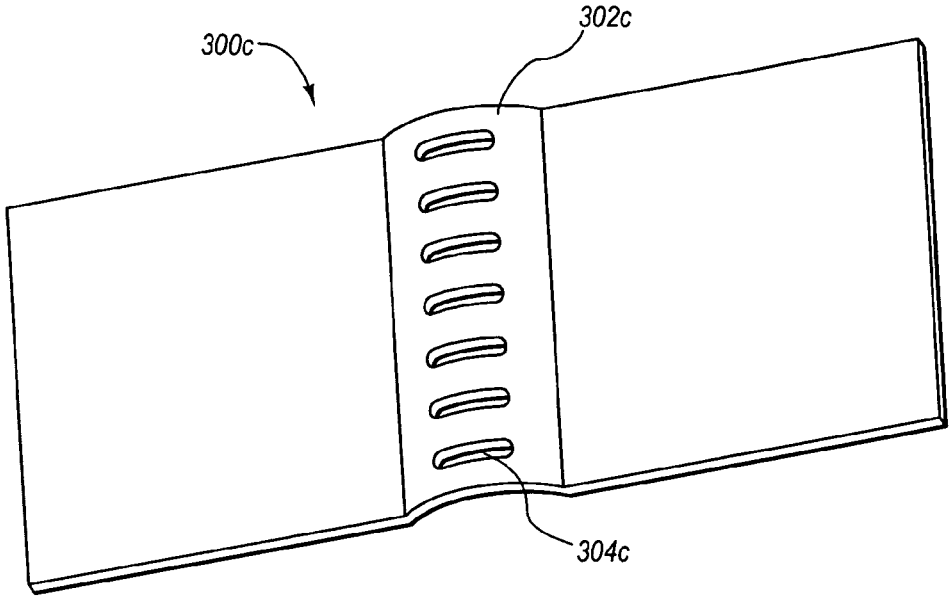
FIG. 7C illustrates another electron emitter, according to an alternative embodiment of the present invention.

FIG. 7C depicts another alternate embodiment of an electron emitter assembly 300*c* that is similar in many respects to FIG. 7A. The electron emitter 300*c* consists of a solid refractory metal foil with a dimple region 302*c* that includes a plurality of transverse slots designed to increase current density in dimple area 302*c*. Designed for increasing emission from center of foil.

Figure 7D:
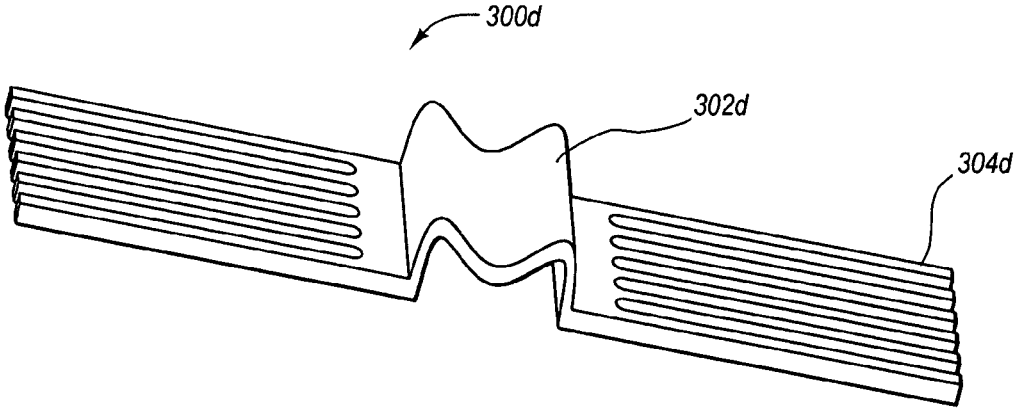
FIG. 7D illustrates another electron emitter, according to an alternative embodiment of the present invention.

Finally, FIG. 7D depicts another alternate embodiment of an electron emitter assembly 300*d* that is similar in many respects to FIG. 7A. The electron emitter 300*d* consists of a solid refractory metal foil with a complex dimple region 302*b* to shape electron emitter fields. In addition, electron emitter 300*d* includes plurality of slots 304*d* for thermal heat sinking.

In addition to the depicted embodiments, thickness may be modulated from side to side to shape the thermal emission profile.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electron emitter assembly, comprising:

a refractory metal element configured to emit a flux of electrons when the refractory metal element is electrically energized, the refractory metal element comprising:

a plurality of electrically interconnected rungs, each rung including a middle portion disposed between two end portions; and wherein the middle portion has a relatively wider cross-section than at least one of the end portions.

2. An electron emitter assembly as recited in claim 1, wherein the refractory metal element is configured so as to be capable of being at least partially disposed within a recess formed within a cathode head structure.

3. An electron emitter assembly as recited in claim 1, wherein the refractory metal element includes at least one angled surface that controls the emission of the electrons in two dimensions so as to define an electron beam.

4. An electron emitter assembly as recited in claim 3, wherein the electron beam is focused in an X-Z plane.

5. An electron emitter assembly as recited in claim 1, wherein a cross-section of each rung is configured such that the plurality of rungs collectively emit a substantially parallel beam of electrons when the refractory metal element is energized.

6. An electron emitter assembly as recited in claim 1, wherein each rung has an associated temperature gradient that defines a temperature-dependent electron emission profile where the electron flux drops by about a factor of 2 for about every 80° C. in temperature drop.

7. An electron emitter assembly as recited in claim 6, wherein the associated temperature gradient ranges from about 2500° C. at the middle portion to about 700° C. at the two end portions.

8. An electron emitter assembly as recited in claim 1, wherein the rungs are electrically connected to one another in series.

9. An electron emitter assembly as recited in claim 1, wherein the rungs are electrically connected to one another in parallel.

10. An electron emitter assembly as recited in claim 1, wherein at least a portion of the refractory metal element defines a heat transfer path to a heat sink.

11. An electron emitter assembly as recited in claim 1, wherein the refractory metal element comprises tungsten, tantalum, a tungsten-tantalum alloy, or a tungsten-thorium alloy, and combinations thereof.

12. An electron emitter assembly as recited in claim 1, wherein the refractory metal element further comprises a carbon dopant.

13. An x-ray tube, comprising:

a vacuum enclosure;

an anode positioned within the vacuum enclosure and including a target surface; and a cathode spaced apart from the target surface, the cathode including an electron emitter assembly comprising:

a refractory metal foil configured for emitting a beam of electrons that is thermally controlled in two dimensions, the refractory metal foil comprising:

first and second end portions disposed substantially in a first plane, a middle portion that is disposed substantially in a second plane that is offset from and parallel with the first plane, and a plurality of cut-outs that define a plurality of horizontal rungs.

14. An x-ray tube as recited in claim 13, wherein the anode is a stationary anode.

15. An x-ray tube as recited in claim 13, wherein the anode is a rotating anode.

16. An x-ray tube as recited in claim 13, further comprising a heat sink that is in thermal communication with at least a portion of the refractory metal foil.

17. An x-ray tube as recited in claim 13, wherein each of the plurality of rungs define a shape that balances electrical current density, resistance, and thermal conduction and radiation such that a heating electrical current excites emission of electrons from a selected portion of each rung in a predetermined profile.

18. An x-ray tube as recited in claim 13, wherein each rung has a middle portion and two end portions, the middle portion having a relatively wider cross-section than the end portions.

19. An x-ray device, comprising:

a vacuum enclosure;

an anode positioned within the vacuum enclosure and including a target surface; and a cathode spaced apart from the target surface, the cathode including an electron emitter assembly comprising:

a refractory metal foil emitter configured to emit a beam of electrons that is focused in two dimensions, the refractory metal foil comprising:

first and second end portions, a depressed middle portion, and a plurality of cut-outs that define a plurality of rungs, with the plurality of rungs being interleaved with the plurality of cut-outs, wherein each rung has a middle portion and two end portions, the middle portion having a relatively wider cross-section than the end portions, and wherein the cross-section of each rung is selected to balance current density, resistance, and thermal conduction and radiation such that a focused beam of electrons is collectively emitted from the rungs.

20. An x-ray device as recited in claim 19, wherein the rungs are arranged substantially parallel to one another between the first and second end portions.

21. An x-ray device as recited in claim 19, wherein the cathode further comprises a heat sink that is in thermal communication with at least a portion of the refractory metal foil.

22. An x-ray device as recited in claim 19, wherein the refractory metal foil is fabricated from tungsten, tantalum, a tungsten-tantalum alloy, or a tungsten-thorium alloy, and combinations thereof.

23. An x-ray device as recited in claim 22, wherein the refractory metal foil further comprises a carbon dopant.

24. An x-ray device as recited in claim 19, wherein the refractory metal foil is fabricated from a tungsten-thorium alloy.

25. An x-ray device as recited in claim 24, wherein the tungsten-thorium alloy further comprises a carbon dopant.

* * * * *